US006095882A

United States Patent [19]

Wells et al.

[11] Patent Number: 6,095,882

[45] Date of Patent: Aug. 1, 2000

[54] METHOD FOR FORMING EMITTERS FOR FIELD EMISSION DISPLAYS

[75] Inventors: David H. Wells; David A. Cathey, both of Boise, Id.

[73] Assignee: Micron Technology, Inc., Boise, Id.

[21] Appl. No.: 09/250,129

[22] Filed: Feb. 12, 1999

[51] Int. Cl.[7] ..... H01J 9/02

[52] U.S. Cl. ..... 445/24; 445/50

[58] Field of Search ..... 445/24, 50; 438/20

[56] References Cited

U.S. PATENT DOCUMENTS

| | | | |
|---|---|---|---|
| 4,107,070 | 8/1978 | Moritz et al. | 96/36 |
| 4,775,609 | 10/1988 | McFarland | 430/325 |
| 4,814,243 | 3/1989 | Ziger | 430/30 |
| 5,372,973 | 12/1994 | Doan et al. | 437/228 |
| 5,391,259 | 2/1995 | Cathey et al. | 156/643 |
| 5,766,829 | 6/1998 | Cathey, Jr. et al. | 430/394 |
| 5,891,321 | 4/1999 | Bernhardt | 445/50 |

OTHER PUBLICATIONS

Lucas, Mark, "Lithography for FED Production," *Information Display*, 4&5, 1997, pp. 20–23.

Mack, Chris A., "Understanding focus effects in submicron optical lithography," *Optical/Laser Microlithography*, SPIE vol. 922, 1988, pp. 135–147.

*Primary Examiner*—Kenneth J. Ramsey
*Attorney, Agent, or Firm*—Dorsey & Whitney LLP

[57] ABSTRACT

A method for creating emitters of a field emission device is provided. First, a hardmask layer is deposited on a substrate used to form emitters. On the hardmask layer, a photoresist layer is deposited. Islands of photoresist are exposed by an exposing energy through holes in a mask layer. The mask layer is removed and the substrate soft-baked in an oven having an atmosphere of basic gas. Following the soft-bake, the substrate is flood exposed, and then developed using conventional means, leaving behind hardened islands of exposed and baked photoresist. The hardmask layer is etched using the hardened islands as an etching barrier, and the substrate etched with a chemical etchant using the etched hardmask layer as an etching barrier. The etching continues until the substrate material below the etched hardmask layer is formed into an array of points of substrate. Once these emitter sites are formed, a field emission display having uniform emitters can be created.

26 Claims, 5 Drawing Sheets

METHOD FOR FORMING EMITTERS FOR FIELD EMISSION DISPLAYS

STATEMENT OF GOVERNMENT INTEREST

This invention was made with government support under Contract No. DABT 63-97-C-0001 awarded by Defense Advanced Research Projects Agency (DARPA). The government has certain rights in this invention.

TECHNICAL FIELD

This invention relates to the production of field emission displays and more particularly to a method for forming emitters for field emission displays using image reversal lithography.

BACKGROUND OF THE INVENTION

Flat panel displays are widely used in a variety of applications, including computer displays. In addition to liquid crystal and plasma displays, one type of device well suited for such applications is a field emission display. Field emission displays typically include a generally planar substrate having an array of electron emitters. In many cases, the emitters are conical projections integral to the substrate.

FIG. 1 is a simplified side cross-sectional view of a portion of a field emission display 110 including a faceplate 120 and a baseplate 121 in accordance with the prior art. FIG. 1 is not drawn to scale. The faceplate 120 includes a transparent viewing screen 122, a transparent conductive layer 124 and a cathodoluminescent layer 126. The transparent viewing screen 122 supports the layers 124 and 126, acts as viewing surface and as a wall for a hermetically sealed package formed between the viewing screen 122 and the baseplate 121. The viewing screen 122 may be formed from glass or other transparent material. The transparent conductive layer 124 may be formed, for example, from indium tin oxide. The cathodoluminescent layer 126 may be segmented into localized portions. In a conventional monochrome display 110, each localized portion of the cathodoluminescent layer 126 forms one pixel of the monochrome display 110. Also, in a conventional color display 110, each localized portion of the cathodoluminescent layer 126 forms a green, red or blue sub-pixel of the color display 110. Materials useful as cathodoluminescent materials in the cathodoluminescent layer 126 include $Y_2O_3$:Eu (red, phosphor P-56), $Y_3(Al,Ga)_5O_{12}$:Tb (green, phosphor P-53) and $Y_2(SiO_5)$:Ce (blue, phosphor P-47) available from Osram Sylvania of Towanda, Pa. or from Nichia of Japan.

The baseplate 121 includes emitters 130 formed on a planar surface of a substrate 132 that is preferably a semiconductor material such as silicon. The substrate 132 is coated with a dielectric layer 134. In one embodiment, this is effected by deposition of silicon dioxide via a conventional TEOS process. The dielectric layer 134 is formed to have a thickness that is approximately equal to or just less than a height of the emitters 130. This thickness is on the order of 0.4 microns, although greater or lesser thicknesses may be employed. A conductive extraction grid 138 is formed on the dielectric layer 134. The extraction grid 138 may be formed, for example, as a thin layer of polysilicon. An opening 140 is created in the extraction grid 138 having a radius that is also approximately the separation of the extraction grid 138 from the tip of the emitter 130. The radius of the opening 140 may be about 0.4 microns, although larger or smaller openings 140 may also be employed.

In operation, the extraction grid 138 is biased to a voltage on the order of 100 volts, although higher or lower voltages may be used, while the substrate 132 is maintained at a voltage of about zero volts. Signals coupled to the emitters 130 allow electrons to flow to the emitter 130. Intense electrical fields between the emitter 130 and the extraction grid 138 cause emission of electrons from the emitter 130.

A larger positive voltage, ranging up to as much as 5,000 volts or more but usually 2,500 volts or less, is applied to the faceplate 120 via the transparent conductive layer 124. The electrons emitted from the emitter 130 are accelerated to the faceplate 120 by this voltage and strike the cathodoluminescent layer 126. This causes light emission in selected areas, i.e., those areas opposite the emitters 130, and forms luminous images such as text, pictures, and the like.

The brightness of the light produced in response to the emitted electrons depends, in part, upon the number of electrons striking the cathodoluminescent layer 126 in a given interval. Field emission microscopy of the emitters 130 reveal that electrons are emitted from only a few atomic sites at the tip of the emitters. The emitting area is very small, generally from 1–5 nm in diameter. Uniformity in the shape, height, and placement of the emitters 130 is an important factor in the quality of the field emission display 110. These parameters affect differences in the number of electrons striking areas of the cathodoluminescent layer 126 that may be perceived by the viewer as bright and dark areas, or as other defects.

For instance, if an emitter 130 is shorter than other emitters, electrons emitted from the tip of the taller emitter may have a tendency to spread out more as they are directed to the cathodoluminescent layer 126. This could cause electrons to bleedover to areas of the cathodoluminescent layer 126 other than those intended, creating a picture defect. Similarly, emitters 130 that are longer than the others may have a tendency to not spread out as much as desired. Mis-located emitters 130 may tend to create a surplus of electrons in one area and a deficiency of electrons in others, also making a deficient picture.

Arrays of emitters 130 can be formed by chemical mechanical polishing steps such as those taught in U.S. Pat. No. 5,372,973, assigned to Micron Technology, Inc. and incorporated herein by reference. These arrays of emitters 130 can also be formed by typical semiconductor fabrication processes such as wet or dry etching of the silicon substrate 132. One example of forming emitters 130 by semiconductor fabrication steps is seen in U.S. Pat, No. 5,766,829 assigned to Micron Technology, Inc. and incorporated herein by reference. In the '829 patent, printed features for defining the size and location of emitter sites are made using phase shift lithography. As seen in FIG. 2 of the '829 patent, by using this method, the phase of exposure energy such as visible light or x-rays is controlled through a reticle in two orientations so that exposed and non-exposed regions or "islands" are produced on a photoresist by destructive or constructive interference. The islands are hardened and then used as etching masks. Isotropic or anisotropic etching is performed on the exposed substrate, while leaving the areas under the islands intact. Etching continues until the areas of the substrate under the islands form points; then the islands are removed. These points become the emitters of the flat panel display.

A problem in using phase shift lithography is that it is difficult to control the photoresist onto which the exposure energy is directed, causing the islands formed on the baseplate to be non-uniform. Later processing with nonuniform islands cause nonuniform emitters to be formed, and ultimately creates a substandard field emission display.

Other semiconductor fabrication technologies have been used to make arrays of emitters 130. For instance, a negative photoresistive material layered on the substrate has been used. Using a negative photoresist to make an array of emitters 130 requires exposing the photoresist only where the islands are to be formed. The exposing energy directed to the negative photoresist hardens the exposed areas and later developing removes the nonexposed areas. This creates an array of islands of exposed photoresist for later processing into an array of emitters 130. However, using a negative photoresist is disfavored for many reasons. It is extremely temperature sensitive, so that normal variations in processing temperatures create nonuniform islands. Some negative photoresist has a tendency to swell during developing, thus preventing its use in very small pattern making. It also has a limited depth of focus. Additionally, developing some negative photoresist requires organic solvents that are flammable as well as difficult and expensive to safely dispose.

A positive photoresistive material can be layered on the substrate, patterned then exposed, but this process also has difficulties. When using a positive photoresist, areas that receive the exposing energy are removed and areas that are shielded from the exposing energy remain after developing. In order to form an array of small islands, most of the positive photoresist is exposed, e.g., over 95%. Trying to create uniform islands of non-exposed positive photoresist is difficult with so much exposing energy applied to the positive photoresist. For instance, if the exposing energy is visible light, excess light tends to undercut the mask, thereby exposing the positive photoresist meant to be covered. In addition, the exposing light is reflected, refracted, and scattered around the photoresist. The same effects occur with x-ray or other exposing energies during exposing times. Unfortunately, these effects are nonuniform which causes the islands of positive photoresist to be nonuniform as well. As described above, it is impossible to create uniform emitters 130 from nonuniform islands.

Thus, it would be desirable to devise a method for creating uniform emitters using fabrication steps that are currently existing.

SUMMARY OF THE INVENTION

According to one aspect of the invention, a method for forming an emitter for a field emission device is provided. A photoresist layer is deposited on a semiconductor material used to form emitters. Islands of the photoresist are exposed by an exposing energy. The temperature of the substrate is increased while in the presence of a basic gas, making the exposed islands non-photoreactive. The photoresist is then flood exposed and developed, leaving behind the hardened islands. Finally, the semiconductor is selectively removed until the semiconductor material below each island is emitter-shaped.

Other aspects of the invention include a field emission device emitter and an array of emitters in a field emission device formed by the above steps.

DETAILED DESCRIPTION OF THE INVENTION

FIGS. 2–7 are cross-sectional views of various stages of manufacturing an emitter baseplate, according to embodiments of the present invention. A procedure 300 for making emitters using image reversal lithography is shown in FIG. 8. This procedure 300 parallels, to some extent, the images shown in FIGS. 2–7 and those shown in the previously incorporated '829 patent.

Figure 1:
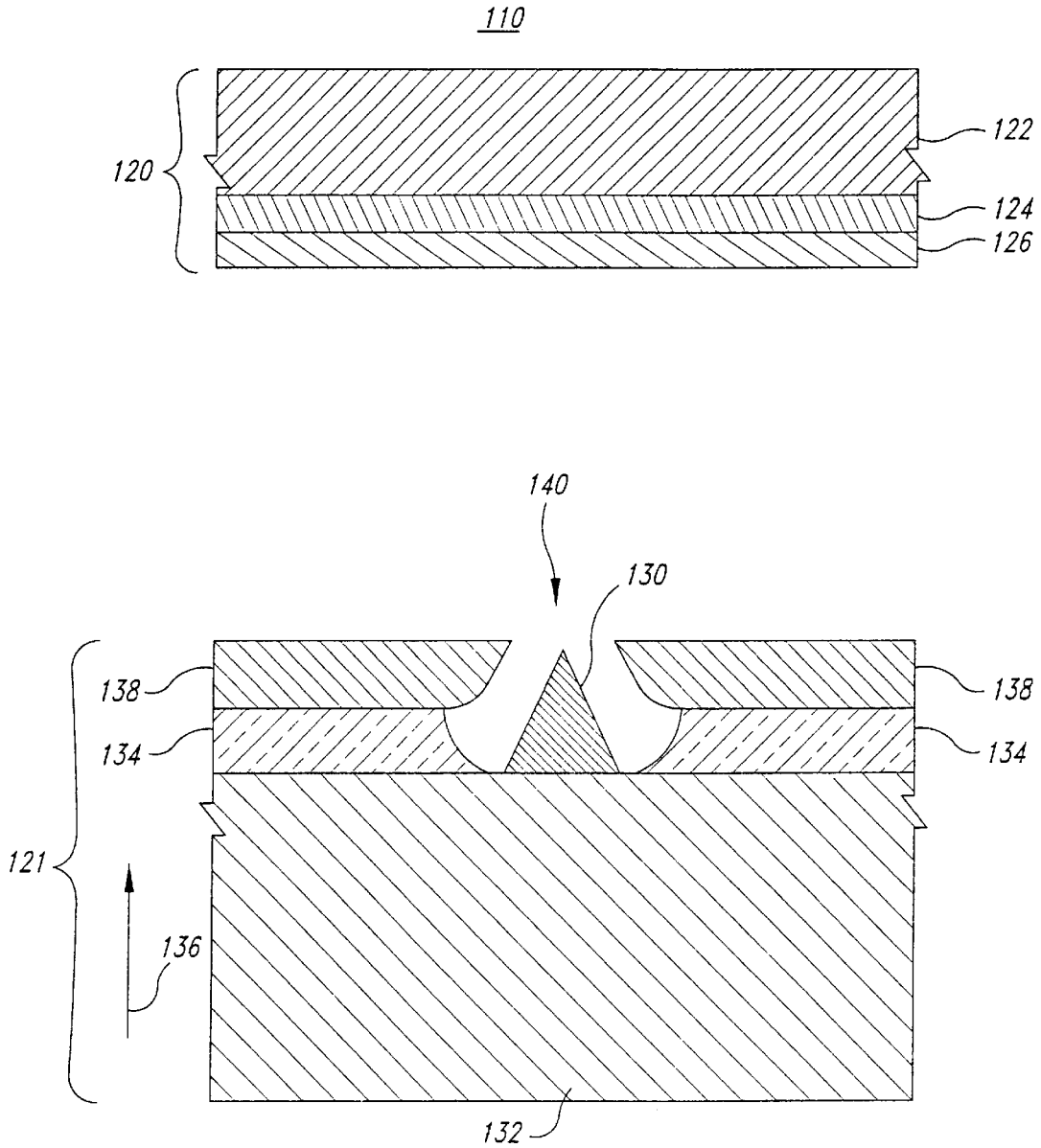
Fig. 1 (PRIOR ART)
FIG. 1 is a simplified side cross-sectional view of a portion of a field emission display according to the prior art.
Figure 2:
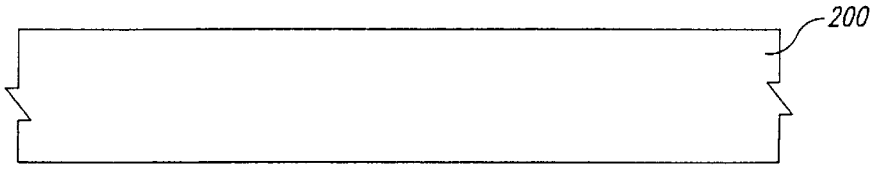
FIG. 2 is a cross-sectional view of a substrate used to form emitters for field emission displays according to an embodiment of the present invention.

FIG. 2 shows a substrate 200 of emitter material. The substrate 200 may be, for example, silicon, molybdenum, palladium oxide, or diamond-like carbon. Additionally, the substrate 200 may be a layer of amorphous silicon disposed over an insulative substrate such as glass. The substrate 200 may be small, having a diagonal measurement of a few centimeters, or less, or the substrate may be large, such as one that can be used for a computer or television monitor. Embodiments of this invention will be described as having the substrate 200 made of silicon and not disposed on an insulative layer, but the invention is in no way limited to this description or limited to the examples cited above.

Figure 3:
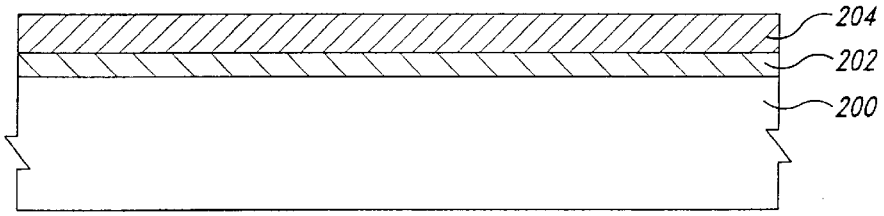
FIG. 3 is a cross-sectional view of the substrate shown in FIG. 2 after layers have been deposited on the substrate.

FIG. 3 shows the substrate 200 of FIG. 2 after a hardmask layer 202 and a positive photoresist layer 204 have been deposited. Using the hardmask layer 202 is optional, but preferred. The hardmask layer 202 can be any material suitable for its purpose and preferably is an oxide layer such as silicon dioxide ($SiO_2$). Additionally, the hardmask layer 202 could comprise a nitride layer, such as silicon nitride ($Si_3N_4$). Further, nickel or chrome or some other suitable metal can be added to the hardmask layer 202. The thickness of the hardmask layer 202 can range between 0.05 and 0.3 microns ($\mu$m), and in the preferred embodiment is 0.2 $\mu$m thick. The positive photoresist layer 204 is one of many available positive photoresist materials, such as those available from Olin. A positive photoresist layer 204 could be, for example, Olin part number HiPR6509 or HPR504. Most preferably, the positive photoresist layer 204 is about 1.1 $\mu$m thick although it preferably ranges from 0.6 to 2 $\mu$m. The step of depositing a hardmask layer 202 and a photoresist layer 204 on a substrate 200 of an emitter material is shown in FIG. 8 as a step 302.

Figure 4:
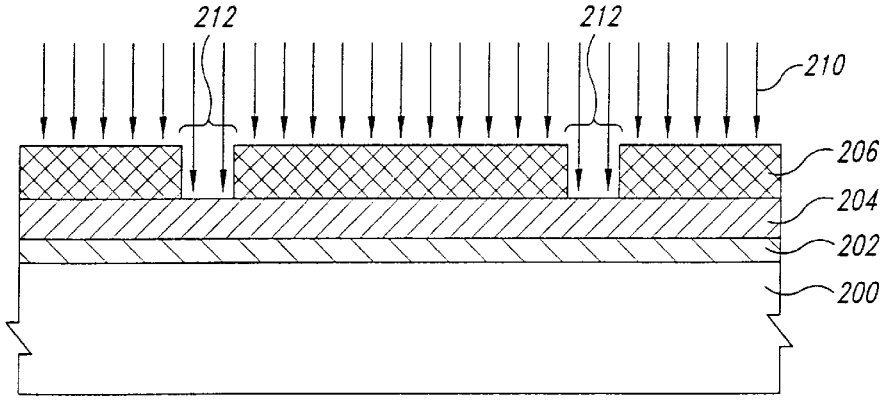
FIG. 4 shows a cross-sectional view of the substrate shown in FIG. 3 after adding a masking layer.

With reference to FIG. 4, following deposition of the hardmask layer 202 and the positive photoresist layer 204 in the step 302, a mask 206 is created and positioned above the positive photoresist layer 204 as is known in the art. This is shown as a step 304 in FIG. 8. Those skilled in the art will appreciate that the mask 206 is typically comprised of a substrate of transparent material, such as quartz, attached to an opaque film. The material attached to the opaque film need only be transparent to the exposing energy, and not necessarily transparent to visible light, unless visible light is used to expose the positive photoresist layer 204. In FIG. 4, only the opaque film portion of the mask 206 is depicted. When referring to the mask 206, it is understood that it is the opaque film portion of the mask 206 that is being referenced.

An exposing energy 210 is directed to the mask 206 and positive photoresist layer 204. The mask 206 has holes or openings through which the exposing energy 210 can pass unperturbed. Typically, when using a positive photoresist layer 204, openings 212 are made in the mask 206 where the underlying photoresist material is to be developed and removed. However, when using image reversal lithography, the pattern of the mask 206 is reversed. That is, when using image reversal lithography, such as is used in the method of FIGS. 2–8, openings 212 are made in the mask 206 where hardened material is eventually desired. The exposing step corresponds to a step 306 in FIG. 8. Areas exposed by the exposing energy 210 through the negative mask 206 will later form islands that are then used to make the emitters 130, as is described in greater detail below.

Figure 5:
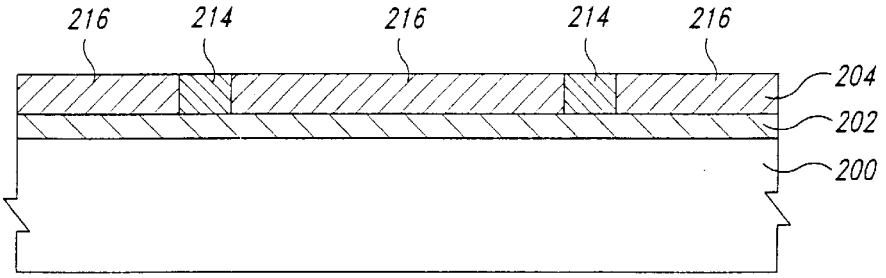
FIG. 5 shows a cross-sectional view of the substrate of FIG. 4 after it has been exposed by an exposing energy and the masking layer removed.

In a step 308, (FIG. 8) the mask 206 used in FIG. 4 is removed, leaving the substrate 200 substantially as shown in FIG. 5. (This Figure also corresponds to FIG. 4 of the '829 patent, although is shown from a different point of reference.) As illustrated in FIG. 5, the exposing energy 210 chemically alters the positive photoresist layer 204. This creates locations within the positive photoresist layer 204 of exposed areas 214 and nonexposed areas 216. The exposed areas 214 substantially align with where the openings 212 within the mask 206 were located. Exposing the positive photoresist layer 204 to the exposing energy 210 causes a release of photo-generated acid within the exposed areas 214. In typical processing of a positive photoresist layer 204, the presence of the acid within the exposed areas 214 is desired, because when the positive photoresist layer 204 is developed, the acid first etches the material within the exposed areas 214. This etched material is later removed. However, when using image reversal lithography, this acid present in the exposed areas 214 is detrimental and must be neutralized.

Figure 6:
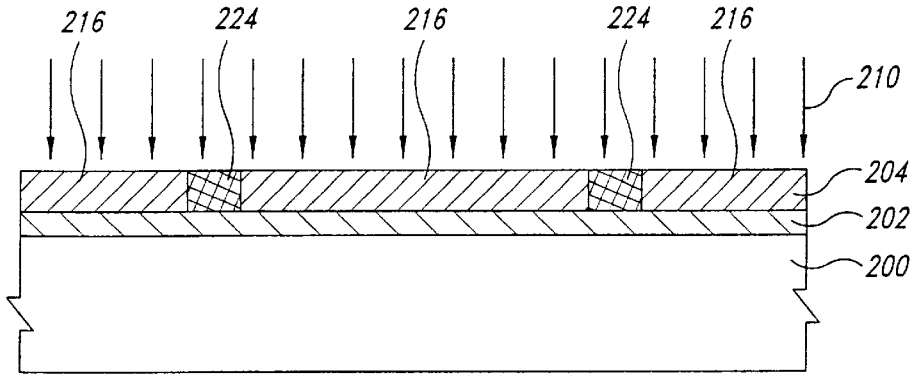
FIG. 6 shows the substrate of FIG. 5 after the exposed areas had been neutralized.

In a step 310 of FIG. 8, the substrate 200 is placed in an oven in the presence of a basic gas (not shown). This baking step 310 causes the exposed areas 214 of the positive photoresist layer 204 to neutralize the photo-generated acid by reacting with the basic gas. Any known method for neutralizing the photo-generated acid could be used. Once these exposed areas 214 are baked in the presence of a basic gas, they are no longer sensitive to light. This is indicated in FIG. 6 by showing the exposed areas 214 of FIG. 5 as exposed and baked areas 224. The nonexposed areas 216 of the positive photoresist layer 204 remain sensitive to light. Neither the increased temperature nor the presence of the basic gas has an effect on the nonexposed areas 216 of the positive photoresist layer 204. These areas 216 remain substantially unchanged.

In a preferred embodiment, the substrate 200 is baked at a temperature of 95° C. in the presence of 100% anhydrous ammonia for between 5 minutes and 2 hours at a pressure slightly below atmospheric pressure, for instance 600 torr. As is known in the art, the procedure to bake the substrate 200 in the presence of 100% anhydrous ammonia is to first place the substrate in an oven that can be evacuated. Then, the oven is evacuated of as much air as practical, and pure nitrogen is pumped into the evacuated space. These steps of evacuating the oven and introducing nitrogen are repeated several times. Each cycle of evacuation and introducing additional nitrogen removes a further quantity of the air originally in the oven. By repeating these steps, nearly all (greater than 99%) of the air can be evacuated. After the final evacuation, anhydrous ammonia is allowed into the oven until a small vacuum remains. This creates a pressure within the oven that is slightly below atmospheric pressure. As stated above, the substrate 200 is then soft-baked at 95° C. for a time between 5 minutes and 2 hours.

In a step 312 of FIG. 8, the entire substrate 200 is flood exposed with an exposing energy 210 which may or may not be the same exposing energy described in step 306. As is known in the art, flood exposure is directing exposing energy 210 at a substrate 200 where no mask 206 is used. This is represented in FIG. 6. Recall that since the areas 224 of the positive photoresist layer 204 have been baked in the presence of a basic gas, they are no longer photosensitive, and are thus not changed by the exposing energy 210. The nonexposed areas 216 of the positive photoresist layer 204 are, however, still photoreactive and release acid when exposed to the exposing energy 210.

In a step 314 of FIG. 8, the positive photoresist layer 204 of the substrate 200 is then developed as normal. It can be developed using tetra-methyl-ammonium-hydroxide (TMAH), which is commercially available from a variety of sources. Other developers such as sodium hydroxide (NaOH) or potassium hydroxide (KOH) may be used for developing. This developing step 314 uses the photo-generated acid from the flood exposure to dissolve the previously non-exposed areas 216 of the positive photoresist layer 204. Full development leaves only the exposed and baked areas 224 of the positive photoresist layer 204 remaining on the hardmask layer 202.

Figure 7:
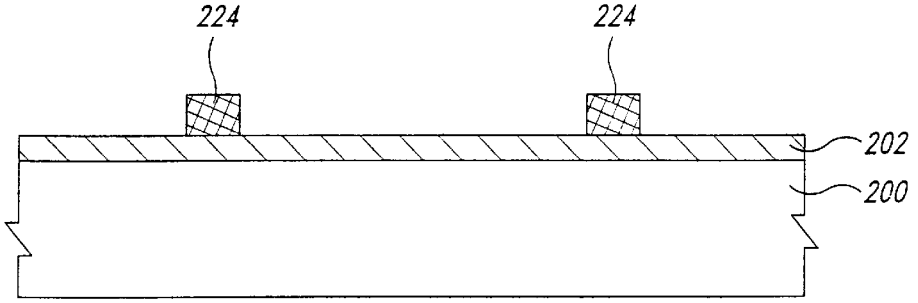
FIG. 7 shows a cross-sectional view of the substrate of FIG. 6 after it has been developed.
Figure 8:
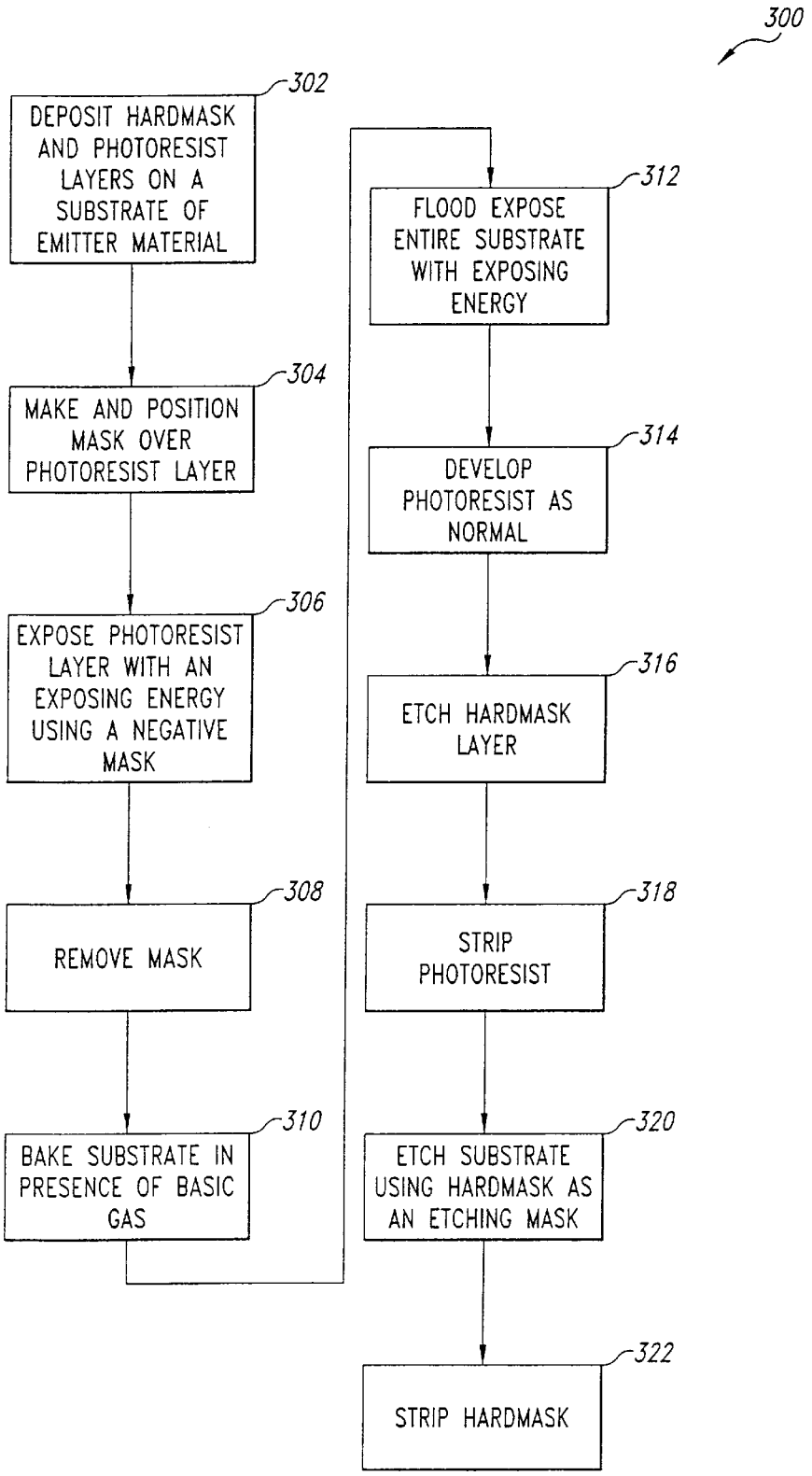
FIG. 8 is a flowchart of a process for manufacturing a field emission display according to an embodiment of the present invention.

Once the step 314 is complete, the substrate 200 will look substantially as shown in FIG. 7, with the exposed and baked areas 224 resting on top of the hardmask layer 202. FIG. 7 directly corresponds to FIG. 5A of the '829 patent, with the substrate 200 corresponding to a baseplate, the hardmask layer 202 corresponding to a mask layer, and the exposed and baked areas 224 corresponding to solid areas of photoresist.

From the state of the substrate 200 as shown in FIG. 7, arrays of emitters 130 can be made by a known method. Examples of making emitters 130 from this stage are described in the '829 patent, column 6, lines 17–64, which has been previously incorporated by reference. Highlights of this description are shown in steps 316–322 of FIG. 8 and as described herein.

A step 316 of FIG. 8 calls for the hardmask layer 202 to be etched, using the exposed and baked areas 224 as an etching mask. If the hardmask layer 202 was not used, then steps 316 and 318 of FIG. 8 are omitted. As described in the '829 patent, etching the hardmask layer 202 can be performed with either a wet etch or a dry etch depending on materials used. For example, if the hardmask layer 202 is silicon nitride, it can be etched with an $SF_6$ based plasma etch. Following the etching of the hardmask layer 204 in step 316, a step 318 shown in FIG. 8 directs that the exposed and baked areas of photoresist 224 be removed. For removal of a positive photoresist, a solution of concentrated $H_2SO_4$ and $H_2O_2$ at about 150° C. can be used. Following this step, the substrate 200 would look substantially similar to the baseplate as shown in FIG. 5B of the '829 patent, with islands of the etched hardmask layer 202 sitting over the substrate 200.

Next, a step 320 of FIG. 8 directs etching the substrate 200 using the etched hardmask 202 as an etching mask. Of course, if the hardmask layer 202 was not used, the substrate 200 is etched using the exposed and baked areas 224 as the etching mask. The etching of the substrate can also be an isotropic or an anisotropic etch. For example, an isotropic etch can use an etching solution of HF, $HNO_3$ and $H_2$. An isotropic etch can use $Cl_2$ chemistries to etch the emitters 130. Once the substrate 200 is completely etched, the substrate will look similar to that of the baseplate as seen in FIGS. 5C or 5D of the '829 patent, depending on whether an isotropic etch or an anisotropic etch are used, respectively.

Finally, in a step 322 of FIG. 8, the etched hardmask layer 202 is stripped with, for instance, a wet etchant such as $H_3PO_4$. Of course, after the array of uniform emitters 130 has been created using the above method, a field emission display can be created using known steps such as the display shown in U.S. Pat. No. 5,391,259, assigned to Micron Technology, Inc. and incorporated herein by reference.

Figure 9:
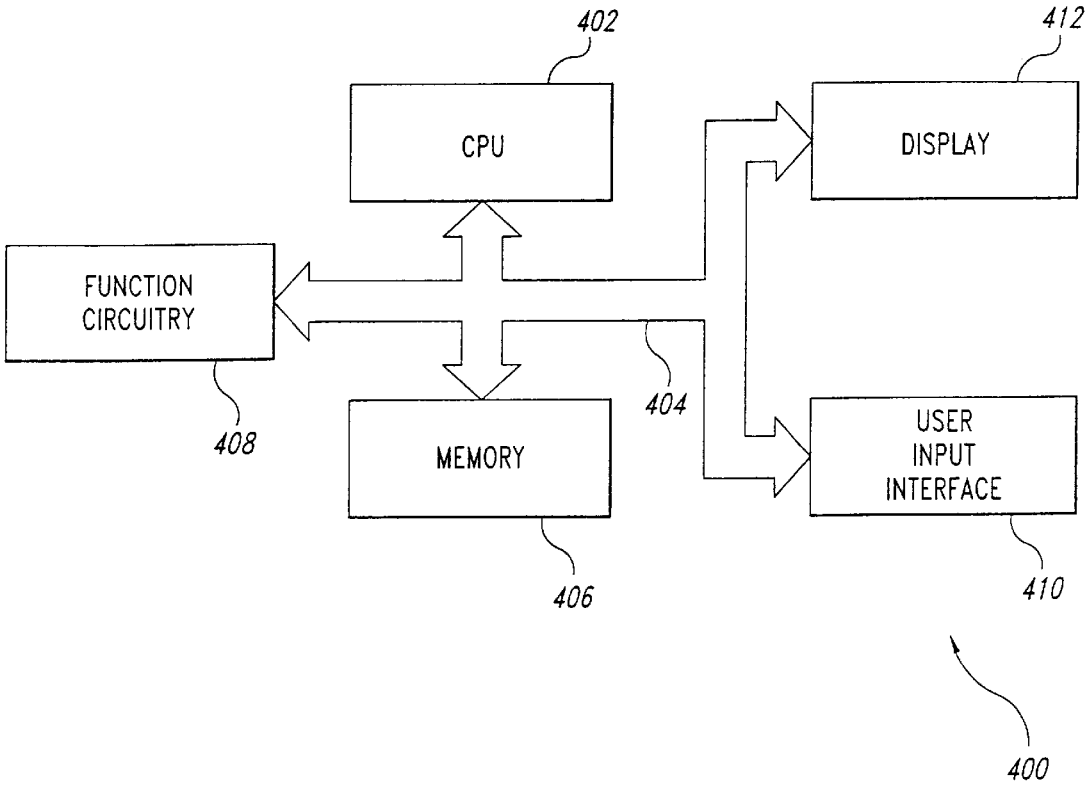
FIG. 9 is a simplified block diagram of a computer including a field emission display formed by embodiments of the present invention.

FIG. 9 is a simplified block diagram of a portion of a computer 400 including a field emission display 412 having the substrate 200 as described with reference to FIGS. 2–7 and associated text. The computer 400 includes a central processing unit 402 coupled via a bus 404 to a memory 406, function circuitry 408, a user input interface 410, and the field emission display 412. The memory 406 may or may not include a memory management module (not illustrated) and does include ROM for storing instructions providing an operating system and a read-light memory for temporary storage of data. The processor 402 operates on data from the memory 406 in response to input data from the user input interface 410 and displays results on the field emission display 412. The processor 402 also stores data in the read-write portion of the memory 406. Examples of systems where the computer 400 finds application include personal/portable computers, camcorders, televisions, automobile electronic systems, microwave ovens, and other home and industrial appliances.

Field emission display 412 for such applications provides significant advantages over other types of displays, include reduced power consumption, improved range of viewing angles, better performance of a wider range of ambient lighting conditions and temperatures, and higher speed with which the display can respond. Field emission displays find application in most devices where, for example, liquid crystal displays find application.

Although the present invention has been described with reference to a preferred embodiment, the invention is not limited to this preferred embodiment. Rather the invention is limited only by the appended claims, which include within their scope all equivalent devices or methods that operate according to the principles of the invention as described.

What is claimed is:

1. A method of forming an emitter for a field emission device, the method comprising:

forming a photoresist layer on a substrate used to form the emitter;

exposing an island of the photoresist with an exposing energy;

increasing the temperature of the substrate in the presence of a basic gas to make the island non-photoreactive;

flood exposing the entire photoresist with a second exposing energy;

developing the photoresist; and selectively removing the substrate until the substrate material below the island is formed into a point.

2. The method of claim 1, further comprising:

forming a hardmask layer on the substrate before forming the photoresist layer; and etching the hardmask layer before selectively removing the substrate.

3. The method of claim 2, further comprising removing the island of photoresist before selectively removing the substrate.

4. The method of claim 1 wherein selectively removing the substrate comprises etching the substrate to form an emitter tip under the island.

5. The method of claim 4 wherein the substrate is isotropically etched.

6. The method of claim 1 wherein increasing the temperature of the substrate in the presence of a basic gas comprises:

placing the substrate in a pre-heated oven;

evacuating the oven to produce a vacuum less than 0.1 torr;

allowing nitrogen into the oven;

repeatedly evacuating the oven and pumping nitrogen into the oven a plurality of times;

introducing anhydrous ammonia into the oven;

baking the substrate for a predetermined time period; and controlling the temperature of the substrate for the duration of the treatment.

7. The method of claim 1 wherein the substrate is amorphous silicon deposited on a glass panel.

8. The method of claim 1 wherein the substrate is crystalline silicon.

9. A method of forming an array of uniform emitters of a field emission device, the method comprising:

forming a hardmask layer by depositing an insulator on a substrate used to form emitters;

forming a photoresist by depositing a layer of positive photoresistive material on the hardmask layer;

exposing a plurality of islands of photoresist with an exposing energy through a respective plurality of holes in a mask layer, the mask layer capable of blocking the exposing energy from reaching the photoresist in areas other than the islands, the holes spaced apart from one another in a pre-selected pattern;

removing the mask layer;

soft-baking the substrate in an oven having an atmosphere of basic gas;

flood exposing the substrate with a second exposing energy;

developing the photoresist, leaving behind hardened islands of exposed and baked photoresist;

etching the hardmask layer using the hardened islands as an etching barrier;

stripping the hardened islands; and etching the substrate with a chemical etchant by using the etched hardmask layer as an etching barrier until the substrate material below the etched hardmask layer is formed into an array of points of substrate.

10. The method of claim 9 wherein the substrate is isotropically etched.

11. The method of claim 9 wherein the oven is held at a pressure less than atmospheric pressure during the soft-baking.

12. The method of claim 9 wherein the exposing energy and the second exposing energy are both ultraviolet light.

13. A method of forming uniform emitters for a large-substrate field emission device, the method comprising the steps of:

depositing a semiconductor material used to form emitters on an insulative substrate;

depositing a photoresist layer on the semiconductor;

exposing areas of the photoresist with an exposing energy;

increasing the temperature of the substrate in the presence of a basic gas to make the exposed areas of the photoresist non-photoreactive;

flood exposing the entire photoresist with a second exposing energy;

developing the photoresist; and etching the semiconductor with a chemical etchant until the semiconductor material below each exposed area of the photoresist is formed into a point.

14. The method of claim 13, further comprising:

forming a hardmask layer on the semiconductor before forming the photoresist layer; and etching the hardmask layer before etching the semiconductor.

15. The method of claim 13, further comprising removing the island of photoresist before etching the semiconductor.

16. The method of claim 13 wherein the substrate is isotropically etched.

17. The method of claim 13 wherein the step of increasing the temperature of the substrate in the presence of a basic gas comprises:

placing the substrate in a pre-heated oven;

evacuating the oven to produce a vacuum less than 0.1 torr;

allowing nitrogen into the oven;

repeatedly evacuating the oven and pumping nitrogen into the oven a plurality of times;

introducing anhydrous ammonia into the oven;

baking the substrate for a predetermined time period; and controlling the temperature of the substrate for the duration of the treatment.

18. A method of forming an emitter for a field emission device, the method comprising:

on a substrate used to form emitters, forming a photoresist layer;

exposing an area of the photoresist layer;

making the exposed area non-photoreactive;

exposing and developing the entire photoresist layer; and selectively removing portions of the substrate until the substrate material is emitter shaped.

19. The method of claim 18, further comprising:

forming a hardmask layer on the substrate before forming the photoresist layer; and etching the hardmask layer before selectively removing the substrate.

20. The method of claim 19, further comprising removing the exposed area of photoresist before selectively removing the substrate.

21. The method of claim 18 wherein selectively removing the substrate comprises etching the substrate to form an emitter tip under the island.

22. The method of claim 18 wherein selectively removing portions of the substrate comprises selective etching of the substrate.

23. The method of claim 22 wherein the substrate is isotropically etched.

24. The method of claim 18 wherein making the exposed area non photoreactive is performed by increasing the temperature of the substrate in the presence of a basic gas by:

placing the substrate in a pre-heated oven;

evacuating the oven to produce a vacuum less than 0.1 torr;

allowing nitrogen into the oven;

repeatedly evacuating the oven and pumping nitrogen into the oven a plurality of times;

introducing the basic gas into the oven;

baking the substrate for a predetermined time period; and controlling the temperature of the substrate for the duration of the treatment.

25. The method of claim 24 wherein the basic gas is anhydrous ammonia.

26. The method of claim 18 wherein the substrate is amorphous silicon disposed on an insulative material.

* * * * *

UNITED STATES PATENT AND TRADEMARK OFFICE

CERTIFICATE OF CORRECTION

PATENT NO. : 6,095,882
DATED : August 1, 2000
INVENTOR(S) : David H. Wells and David A. Cathey It is certified that error appears in the above-identified patent and that said Letters Patent is hereby corrected as shown below:

References Cited, "4,107,070" should read -- 4,104,070 --

Signed and Sealed this

Eighth Day of January, 2002

*Attest:*

*Attesting Officer*

JAMES E. ROGAN
*Director of the United States Patent and Trademark Office*